US010988854B2

(12) United States Patent
Konigshofen et al.

(10) Patent No.: US 10,988,854 B2
(45) Date of Patent: Apr. 27, 2021

(54) FLEXIBLE COLOR ADJUSTMENT FOR DARK CR(III) PLATINGS

(71) Applicants: Andreas Konigshofen, Leverkusen (DE); Maik Winkler, Leipzig (DE)

(72) Inventors: Andreas Konigshofen, Leverkusen (DE); Maik Winkler, Leipzig (DE)

(73) Assignee: MacDermid Enthone Inc., Waterbury, CT (US)

( * ) Notice: Subject to any disclaimer, the term of this patent is extended or adjusted under 35 U.S.C. 154(b) by 0 days.

(21) Appl. No.: 16/709,101

(22) Filed: Dec. 10, 2019

(65) Prior Publication Data

US 2020/0141022 A1 May 7, 2020

Related U.S. Application Data

(63) Continuation of application No. 15/762,599, filed as application No. PCT/US2016/053242 on Sep. 23, 2016, now Pat. No. 10,544,516.

(30) Foreign Application Priority Data

Sep. 25, 2015 (EP) ..... 15186811

(51) Int. Cl.

| | |
|---|---|
| ***C25D 21/06*** | (2006.01) |
| ***C25D 3/06*** | (2006.01) |
| ***C25D 21/12*** | (2006.01) |
| ***C25D 3/10*** | (2006.01) |
| ***C25D 3/08*** | (2006.01) |

(52) U.S. Cl.

CPC ..... *C25D 21/06* (2013.01); *C25D 3/06* (2013.01); *C25D 3/08* (2013.01); *C25D 3/10* (2013.01); *C25D 21/12* (2013.01)

(58) Field of Classification Search

CPC ..... C25D 3/04–10; C25D 21/06

See application file for complete search history.

(56) References Cited

U.S. PATENT DOCUMENTS

| | | | |
|---|---|---|---|
| 3,857,765 | A | 12/1974 | Merker et al. |
| 4,197,167 | A | 4/1980 | Wright, Jr. |
| 4,278,512 | A | 7/1981 | Barclay et al. |
| 4,374,007 | A | 2/1983 | Barclay et al. |
| 4,384,929 | A | 5/1983 | Tremmel et al. |
| 4,432,843 | A | 2/1984 | Tremmel |
| 4,502,890 | A | 3/1985 | Urbanic |
| 7,935,181 | B2 | 5/2011 | Hayes et al. |
| 9,689,081 | B2 | 6/2017 | Schulz et al. |
| 2002/0060157 | A1 | 5/2002 | Calvert et al. |
| 2002/0112952 | A1 | 8/2002 | Blachier et al. |
| 2003/0066756 | A1 | 4/2003 | Gabe et al. |
| 2007/0278158 | A1 | 12/2007 | Lakshman |
| 2010/0243463 | A1 | 9/2010 | Herdman et al. |
| 2012/0111731 | A1 | 5/2012 | Chapaneri et al. |
| 2012/0172216 | A1 | 7/2012 | Bohringer et al. |
| 2013/0213813 | A1 | 8/2013 | Hingley et al. |
| 2014/0042033 | A1 | 2/2014 | Schulz et al. |
| 2015/0376015 | A1 | 12/2015 | Yanagi et al. |
| 2016/0031713 | A1 | 2/2016 | Fish et al. |

FOREIGN PATENT DOCUMENTS

| | | | |
|---|---|---|---|
| CN | 102660759 | A | 9/2012 |
| CN | 103534388 | A | 1/2014 |
| EP | 0496416 | | 4/1995 |
| EP | 1215304 | | 6/2002 |
| JP | 59-41487 | | 3/1984 |
| JP | 2012521495 | A | 9/2012 |
| JP | 2014-235815 | | 12/2014 |
| JP | 2014235815 | | 12/2014 |
| JP | 2015-510549 | | 4/2015 |
| KR | 10-2002-0031043 | | 4/2002 |
| KR | 10-2013-0118248 | | 10/2013 |
| KR | 10-2014-0027200 | | 3/2014 |
| KR | 101421503 | B1 | 7/2014 |
| WO | 2010110812 | A1 | 9/2010 |
| WO | 2012/150198 | | 11/2012 |
| WO | 2013/122774 | | 8/2013 |
| WO | 2014/095648 | A1 | 6/2014 |
| WO | 2014/110416 | | 7/2014 |
| WO | 2014/169163 | A1 | 10/2014 |

OTHER PUBLICATIONS

Haist-Gulde, B., Backwashing characteristic of granular activated card (GAC) from Asia, Techneau, Dec. 6, 2006, Deliverable No. D 5.3.10.

PubChem, 2-Thiazolidinethione, Apr. 23, 2019, pp. 1-22.

Gao, L. et al., Chromium plating method using trivalent chromium, Translation of CN102660759, Sep. 12, 2012.

ANC Korea, Translation of KR1421503, Jul. 22, 2014.

*Primary Examiner* — Brian W Cohen
*Assistant Examiner* — Ho-Sung Chung
(74) *Attorney, Agent, or Firm* — Carmody Torrance Sandak & Hennessey LLP

(57) ABSTRACT

The invention relates to a method for the adjustment of the lightness L* of electrolytically deposited chromium-finishes on workpieces obtained by an electroplating bath comprising at least chromium(III)-ions and sulfur containing organic compounds, wherein the concentration of the sulfur containing organic compounds in the bath are adjusted by passing at least part of the bath composition through an activated carbon filter. Furthermore, the invention is directed to dark chrome coatings comprising a defined concentration gradient of deposited sulfur containing organic compounds.

18 Claims, No Drawings

FLEXIBLE COLOR ADJUSTMENT FOR DARK CR(III) PLATINGS

FIELD OF THE INVENTION

The invention generally relates to a method for the adjustment of the lightness L* in electrolytically deposited trivalent chromium finishes on workpieces. Furthermore, the invention is generally directed to dark trivalent chrome coatings.

BACKGROUND OF THE INVENTION

The first perception of a consumer about the functionality and/or aesthetics of a product is to a large extent influenced by the surface appearance of the product. Such fundamental perceptions are especially a concern in the automotive and consumer goods industries. There are a variety of manufacturing processes which are able to alter and improve the surface characteristics of products. Among the established surface modification processes, particularly for electrolytically deposited metal finishes, are to provide additional product benefits like corrosion resistance, brightness, wear resistance, endurance and specific surface coloration. These beneficial characteristics are not provided, or at least not provided to the extent necessary, by the products themselves, without the surface modification processes. Unique and environmentally friendly decorative coatings for customer goods and the automotive sector can, for instance, be obtained using chrome finishes. In recent years, decorative black chrome(III) finishes have come to the attention of consumers. The dark coatings are, in principle, obtainable via electrodeposition from different trivalent chromium electroplating baths. The literature cites several different approaches for obtaining dark coatings.

One method for achieving electrolytically deposited dark chromium layers is given by Abbott et al., utilizing ionic liquids, choline chloride and lithium chloride (Metal Finishing, 1982, 107-112). Another method for achieving dark chromium plated layers is disclosed by Abdel Hamid et al. utilizing a bath comprising cobalt ions and hexafluorosilicic acid ($H_2SiF_6$) in combination with $Cr^{3+}$ ions (Surface & Coatings Technology 203, 2009, 3442-3449). These references are hereby incorporated by reference in their entirety.

Furthermore, WO 2012 150198 A2, hereby incorporated by reference, teaches using sulfur containing compounds of special molecular structures I or II:

(I)

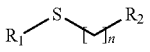

or (II)

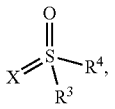

in order to achieve especially dark trivalent chromium finishes.

Although each of these prior art processes is able to deliver dark trivalent chrome coatings, it is disadvantageous for the plating industry that different grades of lightness are demanded by the market. Special electrolyte formulations have to be developed, produced and delivered for every single customer's desired grade of lightness in a plated deposit. This situation is common in the case of original equipment manufacturers (OEMs), wherein different OEMs prefer to establish different dark chromium brand colors. Such development is labor-intensive and the logistics are complicated and costs are high. This requires a manufacturer to have a wide variety of products available depending on the amount of lightness required in the plated deposit for each product. Furthermore, it is disadvantageous for the plating industry that only one specific surface coating is available from one electrolyte and that the bath has to be replaced and tank cleaned if coatings of a different lightness are required.

Therefore, it is the endeavor of the present invention to provide a reliable and flexible electroplating process to provide desired lightness within the plated deposits.

SUMMARY OF THE INVENTION

It is an object of the current invention to provide a trivalent chromium electrolyte bath wherein it is possible adjust the lightness of the resulting trivalent chrome deposits without the need to exchange the complete electrolyte.

It is another object of the current invention to provide a trivalent chromium electrolyte bath that comprises Cr(III) ions and sulfur containing organic compounds.

It is yet another object of the current invention to pass at least part of the trivalent chromium electrolyte through an activated carbon filter.

It is a further object of the current invention to provide dark chromium layers comprising a defined concentration gradient of sulfur containing organic compounds.

To that end, the invention generally relates to a method for the adjustment of the lightness L* of an electrolytically deposited chromium-finish on a workpiece comprising:

a) providing an electroplating bath comprising chromium (III)-ions and sulfur containing organic compounds, wherein in the concentration of the sulfur containing organic compounds in the bath is adjusted by passing at least part of the electroplating bath through an activated carbon filter; and b) placing the workpiece in the electroplating bath.

In another preferred embodiment, the invention also includes a dark electroplated trivalent chromium-layer on a workpiece, wherein the trivalent chromium layer comprises a negative sulfur concentration gradient in the direction from the bottom to the top of the electroplated layer, and wherein the sulfur concentration gradient is obtained by activated carbon inline-filtration of a trivalent chromium electrolyte during electroplating.

DETAILED DESCRIPTION OF THE PREFERRED EMBODIMENTS

The current invention solves the problem of a manufacturer having to provide multiple electrolytes to provide a desired shade of dark colored chromium deposits. With the current invention, the adjustment of the lightness L* of electrolytically deposited chromium-finishes can be controlled using a single electrolyte comprising chromium (III)-ions and sulfur containing organic compounds. The concentration of the sulfur containing organic compounds in the bath is adjusted by passing at least part of the bath composition through an activated carbon filter. Surprisingly it has been found that it is possible to control and adjust the amount of sulfur containing organic compounds in a chromium (III)-electrolyte prior to electroplating by a filtration step without alteration or disturbance of other bath characteristics. Consequently the inventors were able to achieve high quality trivalent chromium coatings of varying lightness using a single electrolyte.

Without being bound by theory, it is proposed that this is possible due to the selective reduction of the concentration of sulfur containing organic compounds in the bath, which influence the lightness of the dark chrome deposits. Removal of the sulfur containing organic compounds from the electrolyte bath results in electroplating of lighter coatings compared to the darker coatings of unfiltered bath compositions comprising a higher content of sulfur containing organic compounds. Therefore, it is possible to utilize only one standard electrolyte composition comprising a standard concentration of sulfur containing organic compounds which is adjusted prior to electroplating to a distinct concentration by filtering at least a part of the electrolyte composition.

In comparison to coatings achieved from the standard starting concentration of sulfur containing organic compounds, it is possible to tailor the degree of lightness of a plated deposit without changing the electrolyte and losing production efficiency due to maintenance and cleaning. The degree of change in lightness of the deposit is determined by the overall amount of filtered electrolyte and the efficiency of the filter unit. By using the inventive process it is also possible to remove the complete amount of sulfur containing organic compounds from the electrolyte and achieve the deposition color of standard chrome coatings. It is especially surprising, that after the filtration step, the concentration and functionality of the other bath components remain unaffected and only the lightness of the trivalent chromium coating is affected.

Without being bound by the theory, it is believed that this feature of selective removal is a function of the activated carbon. The activated carbon allows for the inventive selectivity with respect to the sulfur containing organic compounds. There is little to no absorbance of other bath species in the activated carbon filter. Another advantage of the inventive method is that the method is compatible with other color influencing agents such as saccharin, thiocyanide, thiourea, allylsulfonate or alloy metals for trivalent chromium deposits, such as iron, nickel, copper, indium, phosphorous, tin, and tellurium.

By using sulfur containing organic compounds in the bath and a filter unit, it is possible to adjust the lightness L* of the deposited chromium layers. The lightness L* is the lightness component of the Lab color space and ranges from 0 to 100, wherein L*=0 represents the darkest black and L*=100 the brightest white. In principle it is possible to generate a wide range of L* values, for instance of L*≥30 and ≤95. For the purpose of deposits resulting from using the method provided herein, L' values in the range of L*≥40 and ≤90 can be achieved. More preferably, L*≥45 and ≤85 is achieved using the inventive method.

The source of the trivalent chromium ions ($Cr^{3+}$, trichrome or chrome(III)) may be any chromium compound comprising chromium in the oxidation state +III. Preferably, the source of trivalent chromium ions is at least one compound selected from the group consisting of chromium chloride, chromium sulfate, chromium nitrate, chromium phosphate, chromium dihydrogen phosphate, chromium acetate, and mixtures thereof. Especially preferred are chromium sulfate and chromium chloride, because these salts exhibit desirable deposit characteristics and stable coating results when present in the electrolyte solution.

Electrolytically deposited chromium finishes can be obtained by a chloride- or sulfate-based electrolyte using graphite or composite anodes and additives to prevent oxidation of trivalent chromium at the anodes. It is also possible to use a sulfate based electrolyte using shielded anodes or a sulfate based bath using an insoluble catalytic anode that maintains an electrode potential level that prevents oxidation of the trivalent chromium. The thickness of the deposited finishes may vary from several nm for decorative finishes up to several hundred μm for hard chrome applications. Therefore, the thickness using the inventive method may be in the range of 10 nm up to 1000 nm, preferably in the range from 100 up to 500 nm for decorative coatings and in the range from 1 μm up 150 μm, preferably 5 up to 50 μm for hard chrome plating.

Suitable workpieces for the inventive method may be any suitable metallic or non-metallic substrates. The workpieces may comprise an additional coating for further change of the surface properties of the workpiece, such as a nickel coating.

The inventive electrolyte comprises a source of Cr(III)-ions and further suitable compounds like buffers, complexing agents, inorganic or organic acids, catalysts, other metal-ions, wetting agents, further brightening or color changing agents and conductivity salts.

Within a preferred embodiment of the invention the electrolyte is essentially free of hexavalent chromium, wherein the electrolyte is essentially free of hexavalent chromium if the molar ratio of trivalent to hexavalent chromium (Cr(III)/Cr(VI)) is larger than 100, preferably larger than 1000 and even more preferably larger than 10000.

Within the electrolyte composition, sulfur containing organic compounds are present. The sulfur compounds can be co-deposited in the trivalent chromium deposit either as the originally included compound or as chemically or electrochemically modified versions of the compounds. Suitable sulfur containing organic compounds comprise at least two carbon atoms and one sulfur atom within the same molecule. The molecular weight of the sulfur containing organic compounds in the electrolyte can be between 60 g/mol and 1000 g/mol, preferably between 80 g/mol and 800 g/mol, more preferably between 100 g/mol and 500 g/mol, and most preferably between 100 g/mol and 200 g/mol.

Suitable sulfur compounds exhibit the right solubility in water, achieve efficient dark chromium layers and are effectively and selectively filtered by an activated carbon filter. In addition, the compounds may comprise, besides the sulfur heteroatom, further heteroatoms like O, N, halogens or other chemical groups of bivalent sulfur in combination with carbon and nitrogen atoms, e.g. functional groups like —SCN.

Before the electrolysis of the "standard" (i.e. the initial bath composition) is started, at least a part of the bath composition is filtered by a filter-unit and therefore the concentration of the sulfur containing organic compounds in the electrolyte is reduced. A reduction in the sense of the invention is achieved if the concentration of the sulfur containing organic compounds in the bath is reduced by at least 10%, preferably 15% and more preferably 20% with respect to the initial concentration of the sulfur containing organic compounds in the electrolyte. Such changes in concentration are not achieved by standard consumption of the sulfur compounds in the course of a plating process, without alteration of the desired plating results and depletion of all electrolyte compounds.

The filter unit for the removal of the sulfur containing organic compounds is an activated carbon filter. The filter can be selected from the group comprising a powdered block filter (including powdered activated carbon (PAC)), a solid carbon filter (including extruded solid carbon block (CB)), a granular activated filter (including granular activated carbon (GAC)), and combinations thereof. Carbon block filters are preferred because they are more effective and selective with respect to the sulfur containing organic compounds. The increased surface area of carbon in such filter types makes them more effective. The filter medium can be made of natural material derived from bituminous coal, lignite, wood, coconut shell etc. and can be activated by steam and other means.

According to a preferred embodiment of the invention, the filter-unit selectively filters sulfur containing organic compounds. Such selective filtering in the current invention is achieved if the adsorption behavior of the activated carbon for the sulfur containing organic compounds is at least two times higher compared to the other electrolyte constituents. This relative selectivity can be assessed by measuring the remaining concentration of the components of an electrolyte after passing the electrolyte once through the filter-unit. Without being bound by the theory, it has been found that carbon filters comprising a high Molasses number is an indicator for a high selectivity with respect to sulfur containing organic compounds. This may be attributed to the higher mesopore content of the activated carbon at high Molasses numbers, which in turn favors the adsorption of larger organic molecules.

In another aspect of the invention the activated carbon comprises an active surface area of >0.1 $m^2/g$ and ≤2000 $m^2/g$ determined according to DIN ISO 9277:2010. In order to achieve a sufficient filter efficiency and adsorption capacity, this range of active surface area for the activated carbon has proven to be useful. Within this range desired reduction in concentration of the sulfur containing organic compounds is achieved in a short time or by filtration of just a fraction of the bath. It is undesirable to pass the electrolyte through the filter unit several times. The overall process time is reduced when the electrolyte only requires filtering once. Larger active surface areas are unfavorable, because this enhances the risk of an unselective filtering of the smaller bath constituents. Active carbons with lower active surface area lack the necessary adsorption capabilities.

According to another embodiment of the invention, the activated carbon comprises an Iodine number ≥550 mg/g and ≤1400 mg/g determined according to DIN EN 12902. The Iodine range of the activated carbon comprise the preferred activity range of the carbon in order to filter the sulfur containing organic compounds selectively out of the electrolyte bath and leave the other bath components unaffected. Therefore, an effective reduction in the concentration of sulfur containing organic compounds is achievable. Larger Iodine numbers may be unsuitable because the concentration of other bath components can be affected. Smaller Iodine numbers may result in an insufficient filtering performance. Preferably the Iodine number is in the range of ≥800 mg/g and ≤1300 mg/g, and more preferably ≥850 mg/g and ≤1250 mg/g.

In a preferred embodiment the activated carbon filter comprises a volume ratio of mesopores to the total pore-volume of ≥0.25 and ≤0.8. According to IUPAC, the pore distribution in activated carbons can be structured in micro- (r=0.2-1 nm), meso- (r=1-25 nm) and macro- (r=>25 nm) pores. It has been found that activated carbons exhibiting high mesopore content are very suitable as filtering material. This may be attributable to the fact that the sulfur containing organic compounds are especially absorbed in pores of that size. A lower fraction of mesopores may result in activated carbons comprising a high fraction of micro or macropores, which results in an unspecific adsorption of the other electrolyte constituents. A higher amount of micropores risks too much adsorption and a higher amount of macropores will result in insufficient filtering. The volume ratio of the different pore-classes can be assessed by electron microscopy (REM, AFM) of single activated carbon particle surfaces. In addition, the preferred activated carbon blacks comprise, according to IUPAC, a type IV adsorption isotherm (K. S. W. Sing et al., "Reporting physisorptions data for gas/solid systems with special reference to the determination of surface area and porosity", Pure & Applied Chemistry, (IUPAC Technical Reports and Recommendations 1984), 1985, Vol. 57 (Issue 4), p. 603-619). The preferable filter materials comprise type IV adsorption isotherms.

Another embodiment of the invention is directed to a method, wherein the sulfur containing organic compound is selected from the group consisting of substituted or unsubstituted C2-C30 alkyl- or aryl-sulfur containing organic compounds. These sulfur containing organic compounds have been found to result in dark chromium deposits in the plating process and this group of compounds is efficiently and selectively filterable with the activated carbon filters described herein. The change in the deposit color can be achieved by exchanging just a small fraction of electrolyte bath to remove sulfur compounds while the other electrolyte components are not changed or only reduced by a negligible extent. Sulfur containing organic compounds comprising more C-atoms may be unfavorable, because the filtering efficiency of the activated carbon filter may be reduced at higher molecular weights.

In another aspect the invention relates to a method, wherein the sulfur containing organic compounds comprise at least one N-heteroatom. Without being bound by the theory, it was found that organic molecules comprising at least a nitrogen and a sulfur, are especially suited to achieve homogeneous dark chrome coatings and are selectively and efficiently removed from the electrolyte by an activated carbon filter. Therefore, a wide variety of different chrome colors are available using this method and a change in the deposit color tone can be easily achieved. This reduces the downtime of the bath and increases overall productivity.

In a preferred embodiment of the invention, the sulfur containing organic compound can be selected from the group consisting of substituted or unsubstituted C2-C30 alkyl- or aryl-thiocyanates, thiazoles, thiohydantoin, aminothiourea, rhodanine and mixtures thereof. This special group of sulfur containing organic compounds is able to achieve even and dark chromium deposits at low concentrations and is less prone to generate unwanted degradation products in the course of the plating process. Furthermore, it was found that due to the presence of cyclic structures and the presence of several heteroatoms attached to or within the cyclic structures, the sulfur containing organic compounds can be effectively filtered using activated carbon filters.

In another embodiment of the current invention, the sulfur containing organic compound can be selected from the group consisting of substituted or unsubstituted arninobenzothiazole, 2-methyl-thiohydantoin, 2-mercapto-2-thiazoline, 2-phenylamino-5-mercapto-1,3,4-thiadiazole, benzothiazole and mixtures thereof. The incorporation of N- or S-heteroatoms in 5-membered cyclic structures either as is or additionally attached to further aromatic or non-aromatic structures, achieves a superior processing behavior and filterability. This can be attributed to the solubility of the sulfur containing organic compounds in the electrolyte itself and the right stereochemistry of the compounds to be adsorbed in the mesopores of activated carbon. The efficiency of the filtering process is increased and a fast and effective change of the concentration of the sulfur containing organic compounds is possible.

In a further preferred embodiment, the sulfur containing organic compound is 2-mercapto-2-thiazoline. It has been found that 2-mercapto-2-thiazoline comprises a good color profile and is filtered effectively by the activated carbon filter. Without being bound by theory, this behavior may be attributed to the size of the molecule and a preferred interaction/absorption of the three closely located heteroatoms on this molecule with the carbon surface. Therefore, 2-mercapto-2-thiazoline is preferentially filtered from the solution and fast and easy color adjustment is possible.

Furthermore, an additional aspect of the invention encompasses a method wherein boric acid and/or sulfate-ions and/or chloride-ions are present in the electroplating bath. Surprisingly it was found that the presence of these anions and/or the acid in the electrolyte yields improved qualities in the resulting deposit. In addition, little to no loss of concentration of these substances can be detected in the course of the filtering step. This results in a stable electrolytic bath, wherein the color of the deposit can be adjusted several times.

In another aspect of the invention, potassium thiocyanate (KSCN) is present in the electroplating bath. It was found that the presence of KSCN in the electrolyte bath yields a more even color distribution in the dark chrome plating. Surprisingly, the $SCN^-$ amount in the bath is not significantly affected by the filtration step. Therefore, it is possible to maintain the KSCN in the electrolyte bath and selectively filter the sulfur containing organic compounds in the inventive method.

A dark electroplated chromium-layer on a workpiece is also within the scope of this invention, wherein the layer comprises a negative sulfur concentration gradient in the direction from the bottom to the top of the electroplated layer. The sulfur concentration gradient is obtained by activated carbon inline-filtration of the plating-bath during the electroplating process. The concentration of the sulfur containing organic compounds in the electrolyte can be controllably decreased by selectively filtering the sulfur containing organic compounds to achieve a desired deposit. In the beginning of the plating process a high concentration of sulfur containing organic compounds is deposited, resulting in relatively dark deposits at the bottom of the layer and in the course of the plating process the concentration of sulfur containing organic compounds is reduced in a defined manner, yielding less dark deposits. By using this method it is possible to generate larger color changes in the deposited layer, compared to those resulting from standard losses of sulfur containing organic compounds caused by the consumption of the electrolyte. Due to the fact that the optical appearance of the deposit is not only determined by the outermost layer of the deposit, but also by the layers close to the surface, it is possible to achieve a different optical appearance compared to standard deposits exhibiting a homogenous distribution of the sulfur containing organic compounds.

Within a preferred embodiment of the invention the electroplated workpiece may comprise a difference in the sulfur-content from the bottom to the top of the electroplated layer. This difference is ≥10 mol-% and ≤80 mol-% from the bottom to the top of the plated layer. Such large changes in the deposited amount of the sulfur containing organic compounds as a function of the layer depth result in deposited dark chromium layers exhibiting a different optical appearance compared to deposits obtainable by standard processes. This effect can be tailored as a function of absolute deposited amount, the layer thickness and the established concentration gradient. The concentration gradient in the deposit can be analytically determined by space-resolved X-ray analytics.

Any and all aspects and features of the inventive method shall be deemed applicable and disclosed to the inventive deposit achieved using the method provided herein. Furthermore, all combinations of at least two features disclosed in the claims and/or in the description are within the scope of the invention unless otherwise stated.

EXAMPLES

Example 1: 2-aminobenzthiazole

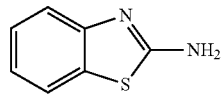

A series of different trichrome deposits were plated on bright nickel surfaces in a Hull cell set-up (5 min, 5 A, 60° C., pH 3.7) using the commercially available electrolyte TRILYTE Flash SF (available from Enthone Inc.). The color and the lightness of the deposits were adjusted by addition of different amounts of 2-aminobenzthiazole and the resulting layers were evaluated using a Spektralphotomer CM-700d/CM-600d (Konica Minolta). The results of the readings are displayed in table I.

TABLE I

Trilyte Flash SF including different amounts of 2-aminobenzthiazole

| | Electrolyte | L* | a* | b* |
|---|---|---|---|---|
| 1 | Trilyte Flash SF | 82.0 | −0.7 | 1.1 |
| 2 | Trilyte Flash SF + 0.05 g/l | 75.2 | −0.5 | 1.2 |
| 3 | Trilyte Flash SF + 0.1 g/l | 68.7 | −0.2 | 1.5 |
| 4 | Trilyte Flash SF + 0.1 g/l + Filtration-step | 81.8 | −0.7 | 1.5 |

It can be deduced from the chromametric assessment of the deposits that an increased amount of sulfur containing organic compounds results in darker deposits. Furthermore, the inventive filtration-step is able to reduce the sulfur containing organic compounds significantly, resulting in deposits of essentially the same quality and exhibiting a very similar color compared to the standard electrolyte. Therefore, it is possible to tailor the lightness of the deposit L* from 68.7 up to 81.8 by using the inventive method with 2-arninobenzthiazole.

Example 2: Thiohydantoin

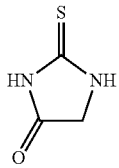

A series of different trichrome deposits were plated on bright nickel surfaces in a Hull cell set-up using TRILYTE Flash CL (available from Enthone Inc.) (5 min, 5 A, 35° C., pH 3.3) and different amounts of thiohydantoin were added. The resulting layers were evaluated using a Spektralphotomer CM-700d/CM-600d (Konica Minolta). The results of the readings are displayed in table II.

TABLE II

Trilyte Flash CL including different amounts of thiohydantoin

| | Electrolyte | L* | a* | b* |
|---|---|---|---|---|
| 1 | Trilyte Flash CL | 78.8 | −0.2 | 0.5 |
| 2 | Trilyte Flash CL + 0.1 g/l | 74.1 | −0.2 | 0.7 |
| 3 | Trilyte Flash CL + 0.2 g/l | 70.2 | −0.1 | 1.1 |
| 4 | Trilyte Flash CL + 0.2 g/l + Filtration-step | 78.5 | −0.2 | 0.4 |

It can be deduced from the chromametric assessment of the deposits that an increased amount of sulfur containing organic compounds results in darker deposits. Furthermore, the inventive filtration-step is able to reduce the sulfur containing organic compounds significantly, resulting in deposits of essentially the same quality and exhibiting a very similar color compared to the standard electrolyte. Therefore, it is possible to tailor the lightness of the deposit L* from 70.2 up to 78.8 by using the inventive method with thiohydantoin.

Example 3: 1,3,4-thiadiazole-2,5-dithiol

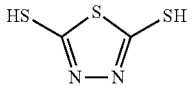

A series of different trichrome deposits were plated on bright nickel surfaces in a Hull cell set-up using TRICOLYTE 4 (5 min, 5 A, 30° C., pH 2.9) (available from Enthone Inc.) and different amounts of 1,3,4-thiadiazole-2,5-dithiol were added to the electrolyte. The resulting layers were evaluated using a Spektralphotomer CM-700d/CM-600d (Konica Minolta). The results of the readings are displayed in table III.

TABLE III

TRICOLYTE 4 including different amounts of 1,3,4-thiadiazole-2,5-dithiol

| | Electrolyte | L* | a* | b* |
|---|---|---|---|---|
| 1 | TRICOLYTE 4 | 75.3 | 0.2 | 2.0 |
| 2 | TRICOLYTE 4 + 0.1 g/l | 70.4 | 0.6 | 2.2 |
| 3 | TRICOLYTE 4 + 0.2 g/l | 66.1 | 0.5 | 2.5 |
| 4 | TRICOLYTE 4 + 0.2 g/l + Filtration-step | 74.8 | 0.3 | 1.8 |

It can be deduced from the chromametric assessment of the deposits that an increased amount of sulfur containing organic compounds results in darker deposits. Furthermore, the inventive filtration-step is able to reduce the sulfur containing organic compounds significantly, resulting in deposits of essentially the same quality and exhibiting a very similar color compared to the standard electrolyte. Therefore, it is possible to tailor the lightness of the deposit L* from 66.1 up to 75.3 by using the inventive method with 1,3,4-thiadiazole-2,5-dithiol.

Example 4: 2-mercapto-2-thiazoline

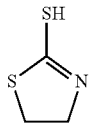

A series of different trichrome deposits were plated on bright nickel surfaces in a Hull cell set-up using TRILYTE DUSK (5 min, 5 A, 33° C., pH 3.3) (available from Enthone Inc.) and different amounts of 2-mercapto-2-thiazoline were added to the electrolyte. The resulting layers were evaluated using a Spektralphotomer CM-700d/CM-600d (Konica Minolta). The results of the readings are displayed in table IV.

TABLE IV

TRILYTE DUSK including different amounts of 2-mercapto-2-thiazoline

| | Electrolyte | L* | a* | b* |
|---|---|---|---|---|
| 1 | TRILYTE DUSK | 58.5 | 0.2 | 3.5 |
| 2 | TRILYTE DUSK + 0.25 g/l | 54.3 | 0.3 | 3.7 |
| 3 | TRILYTE DUSK + 0.5 g/l | 50.1 | 0.4 | 4.1 |
| 4 | TRILYTE DUSK + 0.75 g/l | 46.5 | 0.4 | 4.8 |
| 5 | TRILYTE DUSK + 0.5 g/l + Filtration-step | 59.2 | 0.2 | 3.7 |

It can be deduced from the chromametric assessment of the deposits that an increased amount of sulfur containing organic compounds results in darker deposits. Furthermore, the inventive filtration-step is able to reduce the sulfur containing organic compounds significantly, resulting in deposits of essentially the same quality and exhibiting a very similar color compared to the standard electrolyte. Therefore, it is possible to tailor the lightness of the deposit L* from 46.5 up to 59.2 by using the inventive method with 2-mercapto-2-thiazoline.

Example 5: 2-mercapto-2-thiazoline+KSCN

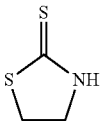

A series of different trichrome deposits were plated on bright nickel surfaces in a Hull cell set-up using Trilyte Flash SF (5 min, 5 A, 60° C., pH 3.7) (available from Enthone Inc.) and different amounts of 2-mercapto-2-thiazoline and 5 g/l KSCN were added to the electrolyte. The resulting layers were evaluated using a Spektralphotomer CM-700d/CM-600d (Konica Minolta). The results of the readings are displayed in table V.

TABLE V

Trilyte Flash SF including different amounts of 2-mercapto-2-thiazoline and 5 g/l KSCN.

| | Electrolyte | L* | a* | b* |
|---|---|---|---|---|
| 1 | Trilyte Flash SF + 5 g/l KSCN | 72.6 | 0.5 | 3.2 |
| 2 | Trilyte Flash SF + 5 g/l KSCN + 0.05 g/l | 68.1 | 0.5 | 3.4 |
| 3 | Trilyte Flash SF + 5 g/l KSCN + 0.1 g/l | 64.3 | 0.6 | 3.7 |
| 4 | Trilyte Flash SF + 5 g/l KSCN + 0.2 g/l | 60.0 | 0.6 | 3.7 |
| 5 | Trilyte Flash SF + 5 g/l KSCN + 0.2 g/l + Filtr. | 72.5 | 0.6 | 3.4 |

It can be deduced from the chromametric assessment of the deposits that an increased amount of sulfur containing organic compounds results in darker deposits. Furthermore, the inventive filtration-step is able to reduce the sulfur containing organic compounds significantly, resulting in deposits of essentially the same quality and exhibiting a very similar color compared to the standard electrolyte. Therefore, it is possible to tailor the lightness of the deposit L* from 60.0 up to 72.6 by using the inventive method with 2-mercapto-2-thiazoline and 5 g/l KSCN. Within this test series it should be pointed out that the KSCN concentration in the electrolyte remains unaffected by the filtration step. This demonstrates that the inventive method is compatible with a wide range of different bath compositions.

The invention claimed is:

1. A method for providing a dark electroplated trivalent chromium layer on a workpiece, the electroplated chromium layer comprising a negative sulfur concentration gradient in a direction from bottom to top of the electroplated trivalent chromium layer, the method comprising the steps of:

a) providing an electroplating bath comprising chromium (III)-ions and sulfur containing organic compounds, b) placing the workpiece into the electroplating bath to deposit a chromium layer on the workpiece; and c) selectively filtering the electroplating bath during plating with an activated carbon filter to adjust a concentration of the sulfur containing organic compounds in the bath and generate a color change in the electroplated chromium layer, wherein the electroplated workpiece exhibits a difference in sulfur-content from bottom to top of the electroplated chromium layer; and wherein the activated carbon filter is configured to preferentially filter the sulfur containing organic compounds while the concentration and functionality of other bath components remain unaffected.

2. A method for adjusting a color of an electrolytically deposited chromium finish on a workpiece, the method comprising the steps of:

a) providing an electroplating bath comprising chromium (III)-ions and sulfur containing organic compounds, b) filtering the electroplating bath to remove at least a portion of the concentration of the sulfur containing organic compounds in the bath by passing the electroplating bath through an activated carbon filter; and c) placing the workpiece into the electroplating bath to electrodeposit a chromium finish on the workpiece;

wherein the activated carbon filter is configured to preferentially remove sulfur containing organic compounds from the bath, such that adsorption of sulfur containing organic compounds by the activated carbon filter is at least two times higher than adsorption of other bath components; and wherein the removal of the sulfur containing organic compounds from the bath adjusts a lightness L* of the electrolytically deposited chromium finish on the workpiece.

3. The method according to claim 2, wherein the activated carbon comprises an active surface area of >0.1 $m^2/g$ and ≤2000 $m^2/g$.

4. The method according to claim 2, wherein the activated carbon comprises an Iodine number of ≥550 mg/g and ≤1400 mg/g.

5. The method according to claim 2, wherein the activated carbon filter comprises a volume ratio of mesopores to the total pore-volume of ≥0.25 and ≥0.8.

6. The method according to claim 2, wherein the sulfur containing organic compounds are selected from the group consisting of substituted or unsubstituted C2-C30 alkyl- or aryl-sulfur containing organic compounds.

7. The method according to claim 6, wherein the sulfur containing organic compounds comprise at least one N-heteroatom.

8. The method according to claim 7, wherein the sulfur containing organic compounds are selected from the group consisting of substituted or unsubstituted C2-C30 alkyl- or aryl-thiocyanates, thiazoles, thiohydantoin, aminothiourea, rhodanine and mixtures thereof.

9. The method according to claim 8, wherein the sulfur containing organic compounds are selected from the group consisting of substituted or unsubstituted aminobenzothiazole, 2-methyl-thiohydantoin, 2-mercapto-2-thiazoline, 2-phenyl amino-5-mercapto-1,3,4-thiadiazole, benzothiazole and mixtures thereof.

10. The method according to claim 9, wherein the sulfur containing organic compound is 2-mercapto-2-thiazoline.

11. The method according to claim 6, wherein additionally boric acid and/or sulfate-ions and/or chloride-ions are present in the electroplating bath.

12. The method according to claim 6, wherein the electroplating bath further comprises KSCN.

13. The method according to claim 6, wherein the molecular weight of the sulfur containing organic compounds is between 60 g/mol and 1000 g/mol.

14. The method according to claim 13, wherein the molecular weight of the sulfur containing organic compounds is between 100 g/mol and 500 g/mol.

15. The method according to claim 2, wherein the thickness of the electrolytically deposited chromium finish is 100-500 nm when the finish is a decorative coating.

16. The method according to claim 2, wherein the thickness of the electrolytically deposited chromium-finish is 5-50 μm when the finish is a hard chrome coating.

17. The method according to claim 2, wherein the L* value of the electrolytically deposited chromium finish is in a range of L*≥40 and ≤90.

18. The method according to claim 17, wherein the L* value of the electrolytically deposited chromium finish is in the range of L*≥45 and ≤85.

* * * * *